US007581359B2

(12) United States Patent
Bukeavich

(10) Patent No.: US 7,581,359 B2
(45) Date of Patent: Sep. 1, 2009

(54) BIRD PERCHING AND NESTING DETERRENT

(76) Inventor: Lisa Bukeavich, 116 Landrum Dr., Martin, TN (US) 38237

( * ) Notice: Subject to any disclaimer, the term of this patent is extended or adjusted under 35 U.S.C. 154(b) by 66 days.

(21) Appl. No.: 11/879,957

(22) Filed: Jul. 19, 2007

(65) Prior Publication Data

US 2009/0019792 A1 Jan. 22, 2009

(51) Int. Cl.

| | |
|---|---|
| ***A01K 3/00*** | (2006.01) |
| ***E04B 1/72*** | (2006.01) |
| ***E04H 9/16*** | (2006.01) |
| ***E04D 13/08*** | (2006.01) |
| ***E04D 1/30*** | (2006.01) |

(52) U.S. Cl. ..... 52/101; 52/16; 52/57; 43/1

(58) Field of Classification Search ..... 52/101, 52/287.1, 717.01, 16, 57, 67, 198, 311.3, 52/312; 43/1, 124; 119/57.9; 285/24
See application file for complete search history.

(56) References Cited

U.S. PATENT DOCUMENTS

| | | | | |
|---|---|---|---|---|
| 168,446 | A | 10/1875 | Blodget | |
| 4,185,420 | A * | 1/1980 | Medland | 52/11 |
| 4,937,988 | A * | 7/1990 | Gratton | 52/101 |
| 5,092,088 | A * | 3/1992 | Way | 52/101 |
| 5,584,147 | A * | 12/1996 | Agee et al. | 52/16 |
| D389,039 | S * | 1/1998 | Smiley et al. | D8/376 |
| 6,056,083 | A * | 5/2000 | Daniell | 181/199 |
| 6,754,997 | B2 * | 6/2004 | Bonin | 52/220.1 |
| 6,820,381 | B1 * | 11/2004 | Ballough | 52/202 |
| 6,918,214 | B2 | 7/2005 | Sabine | |
| 7,007,429 | B2 * | 3/2006 | Kim | 52/16 |
| 7,243,465 | B2 * | 7/2007 | Donoho | 52/101 |
| 2002/0157325 | A1 * | 10/2002 | Domanico | 52/35 |
| 2003/0192264 | A1 * | 10/2003 | Boggs | 52/94 |
| 2005/0223657 | A1 * | 10/2005 | Brochu et al. | 52/94 |
| 2006/0000166 | A1 * | 1/2006 | Rossetti | 52/287.1 |

OTHER PUBLICATIONS

"All Corbels—Save 10%", www.corbelsandcarvings.com/corbels/corbelsdiscount.htm, Feb. 18, 2006.*
"Corbels and Corbel Wood Carvings", www.corbelsandcarvings.com/corbels/corbels.htm, Feb. 18, 2006.*
"Decorative Corbel Wood Carvings", www.corbelsandcarvings.com/corbels/decorative_corbel.htm, Feb. 18, 2006.*
"Wood Corbel Carvings and Brackets", www.corbelsandcarvings.com/corbels/wood$_{13}$ corbel.htm, Feb. 18, 2006.*

* cited by examiner

*Primary Examiner*—Richard E Chilcot, Jr.
*Assistant Examiner*—Andrew J Triggs
(74) *Attorney, Agent, or Firm*—James Ray & Assoc.

(57) ABSTRACT

A decorative bird perching deterrent for spaces between building eaves and downspouts is a substantially right-triangle structure of a preselected material with at least 50 percent of the area bounded by the sides of the right triangle structure filled with the preselected material in a decorative fashion. Various ways of attaching to the downspout or the building are provided near at least one edge of the right-triangle structure.

6 Claims, 2 Drawing Sheets

BIRD PERCHING AND NESTING DETERRENT

FIELD OF THE INVENTION

The present invention relates, in general, to apparatus for deterring bird from perching on and building nests in undesired locations and, more particularly, this invention relates to aesthetically attractive obstacles added to building exteriors to prevent birds from nesting in certain locations.

BACKGROUND OF THE INVENTION

Prior to the conception and development of the present invention, people have sought ways to keeps birds from landing and lodging in areas around building where the birds are not wanted. Bird droppings create unsightly and unhealthy spots on the building and surrounding areas. Blodget in U.S. Pat. No 168,446 disclosed how a multitude of pins can be mounted atop windows, columns, and ledges of buildings to keep birds from landing, or at least from taking up residence. U.S. Pat. No. 5,400,552 teaches construction of deterrents to bird landings using vertical spikes. U.S. Pat. No. 6,918,214 discloses various anti-perch devices made of wire. All of these share the concept of thin elements protruding upward to deter birds from landing, and appearance is of little if any concern.

SUMMARY OF THE INVENTION

The present invention provides a decorative bird perching deterrent for spaces between building eaves and downspouts in the form of a substantially right-triangle structure of a preselected material with at least 50 percent of the area bounded by the sides of the right triangle structure aesthetically filled with the preselected material. Various ways of attaching to the downspout or the building are provided near at least one edge of the right-triangle structure. In one alternative design, gap-filling bristles are added along the hypotenuse side of the structure to make an exact fit unnecessary.

OBJECTS OF THE INVENTION

It is, therefore, one of the primary objects of the present invention to provide decorative building trim that also deters birds from perching or nesting in some common spots.

Another object of the present invention is to provide an attractive yet functional device to fit between building eaves or soffit, and sloping downspouts.

Still another object of the present invention is to provide a decorative bird perching deterrent that can fit multiple size gaps above downspouts.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

DETAILED DESCRIPTION OF A PRESENTLY PREFERRED EMBODIMENT OF THE INVENTION

Figure 1:
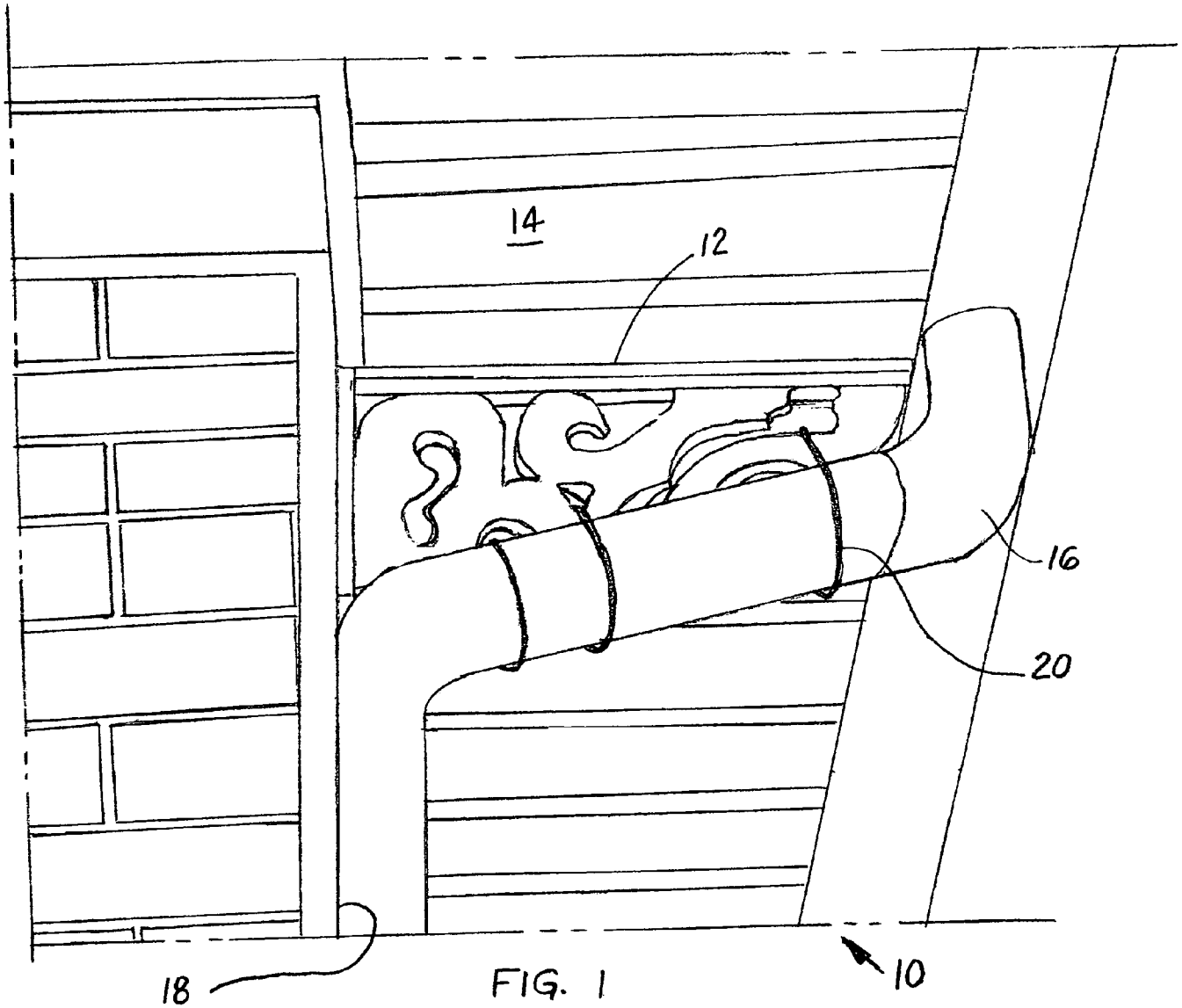
FIG. 1 is a perspective view of the decorative bird deterrent on a downspout at the corner of a house.

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a perspective view of the deployed invention 10 is provided. A right triangular structure 12 fills most of the space between a building wall 18, the soffit 14, and a downspout 16. This area if left open would be a prime nesting spot for a bird. Most of the area defined by side of the triangular structure 12, at least 50 percent, is filled with something solid, preferably in an aesthetically pleasing fashion. The material of construction will preferably be vinyl or metal, but wood and other materials are not excluded. The structure 12 can be held in place on top of the downspout 16 with wire or plastic tiedowns 20 along the longest or hypotenuse side of the substantially right triangle structure 12.

Figure 2:
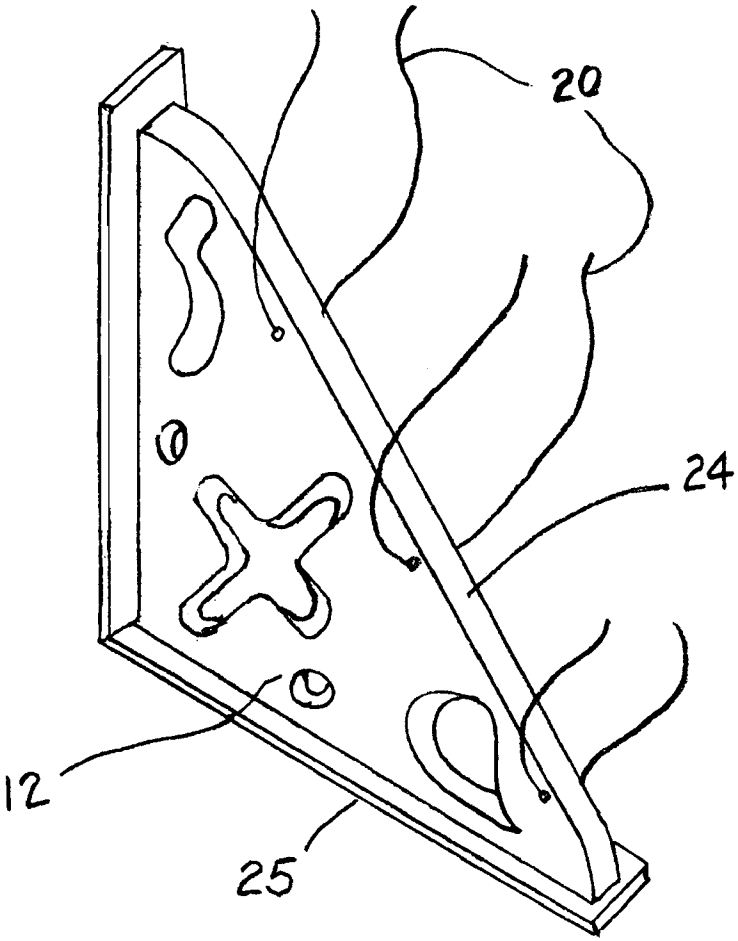
FIG. 2 is a perspective view of a decorative corner trim bird guard by itself.

FIG. 2 provides a perspective view of the structure 12 in an inverted position from how it would normally be installed. Near the hypotenuse edge 24, wire or plastic tiedowns 20 will also be provided as a simpler way of installing by attaching to the downspouts. Herein, the hypotenuse side or edge 24 is that surface opposite the 90-degree angle, and may be linear or very arcuate, and will be proximal an imaginary straight line running between the two distal ends of the substantially straight edges 25 and 26.

Figure 3:
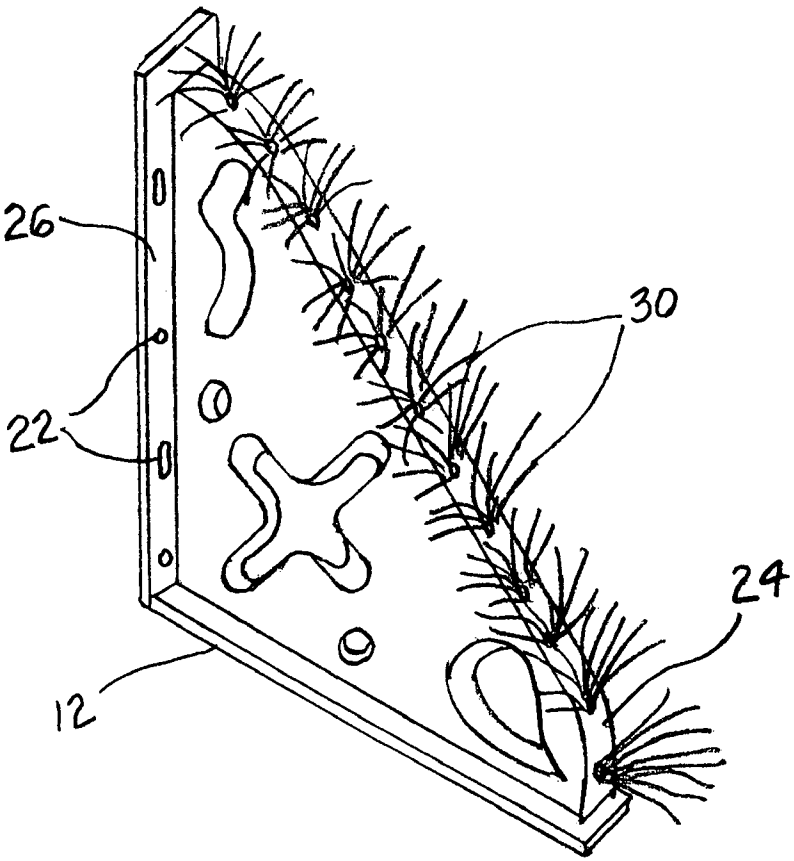
FIG. 3 is a perspective view of a self-adjusting version of the invention.

FIG. 3 is a perspective view of the structure 12 with some optional gap fillers shown. Wire-like substantially-flexible bristles 30 of metal or plastic would be imbedded along the hypotenuse edge 24 so that the structure 12 dimensions would not have to fit the space exactly. For this design, mounting would have to be to the building with screws through the holes 22 in the flange edge 26.

While a presently preferred embodiment of the present invention has been described in sufficient detail above to enable a person skilled in the relevant art to make and use the same, it should be obvious that various other adaptations and modifications can be envisioned by those persons skilled in such art without departing from either the spirit of the invention or the scope of the appended claims.

I claim:

1. A decorative bird perching deterrent, comprising:

a substantially right-triangle structure of a preselected material with at least 50 percent of area bounded by sides of said right-triangle structure filled with said preselected material; and attachment means proximal an hypotenuse edge of said substantially right-triangle structure for holding said substantially right-triangle structure adjacent a building and a rain downspout, wherein said attachment means are wires attached proximal said hypotenuse side of said substantially right-triangle structure, said wires having sufficient length to tie around said rainwater downspout.

2. The decorative bird perching deterrent, according to claim 1, wherein said preselected material is one of wood, metal, and plastic.

3. A decorative bird perching deterrent comprising:

a substantially right-triangle structure of a preselected material with at least 50 percent of area bounded by sides of said right-triangle structure filled with said preselected material; and attachment means proximal an hypotenuse edge of said substantially right-triangle structure for holding said substantially right-triangle structure adjacent a building and a rain downspout, wherein said attachment means are straps attached proximal said hypotenuse side of said substantially right-triangle structure, said straps having sufficient length to fasten around a standard rainwater downspout.

4. The decorative bird perching deterrent, according to claim 3, wherein said preselected material is one of wood, metal, and plastic.

5. A decorative bird perching deterrent comprising:

a substantially right-triangle structure of a preselected material with at least 50 percent of area bounded by sides of said right-triangle structure filled with said preselected material;

attachment means proximal at least one edge adjacent a right angle of said substantially right-triangle structure for holding said substantially right-triangle structure adjacent a building and a rain downspout; and wire-like bristles imbedded along a hypotenuse edge of said right-triangle structure to provide adjustable gap filling.

6. The decorative bird perching deterrent, according to claim 5 wherein said attachment means are screw apertures and screws in a flange area along at least one of two shorter sides of sides of said substantially right-triangle structure.

* * * * *